United States Patent [19]

Brock

[11] 4,326,301

[45] Apr. 27, 1982

[54] COLLAPSIBLE SUNSHADE

[76] Inventor: Louis C. Brock, 13468 Forest Lac, St. Louis County, Mo. 63141

[21] Appl. No.: 801,151

[22] Filed: May 27, 1977

[51] Int. Cl.[3] ..... A42B 1/20; A45B 11/04

[52] U.S. Cl. ..... 2/177; 2/182.6; 135/2; 135/5 C

[58] Field of Search ..... 135/2, 5 C, 19.5, 20 R; 2/177, 182.6, 171

[56] References Cited

U.S. PATENT DOCUMENTS

| | | | |
|---|---|---|---|
| 250,803 | 12/1881 | Gray | 2/177 |
| 1,474,821 | 11/1923 | Hartzell | 135/29 |
| 2,140,647 | 12/1938 | Myers | 135/5 C |
| 2,227,554 | 1/1941 | Riordon | 135/5 C |
| 2,864,389 | 12/1958 | Smith et al. | 135/2 |
| 3,049,720 | 8/1962 | Caine | 135/5 C |
| 3,315,275 | 4/1967 | Erbb | 2/177 |
| 3,374,488 | 3/1968 | Erbb | 2/177 |
| 3,738,378 | 6/1973 | Williams | 135/2 |
| 3,929,146 | 12/1975 | Maiken | 135/2 |

FOREIGN PATENT DOCUMENTS

| | | | |
|---|---|---|---|
| 489092 | 1/1930 | Fed. Rep. of Germany | 135/2 |
| 450887 | 7/1936 | United Kingdom | 135/2 |

*Primary Examiner*—C. J. Husar
*Assistant Examiner*—Conrad Berman
*Attorney, Agent, or Firm*—Gravely, Lieder & Woodruff

[57] ABSTRACT

A sunshade has ribs which emanate from a hub and are connected intermediate their ends to struts which are in turn connected to a center sleeve. When the sleeve is remote from the hub, the ribs and struts lie alongside each other in a collapsed position in which they are generally parallel to the axis of the hub. However, as the sleeve is moved upwardly toward the hub, the struts swing outwardly and push the ribs outwardly. Indeed, the struts pass through an over center position before the sleeve comes against the hub, and when the sleeve is against the hub, the ribs are in an extended position wherein they radiate from the hub. Each rib at its outer end has a rib extension connected to it, and these rib extensions fold between extended positions, wherein they form continuations of their respective ribs, and folded positions wherein they lie alongside their respective ribs. A fabric cover is connected to the ribs and rib extensions and folds with them. Some of the ribs have legs depending from them, and a head band is attached to the lower ends of these legs.

11 Claims, 7 Drawing Figures

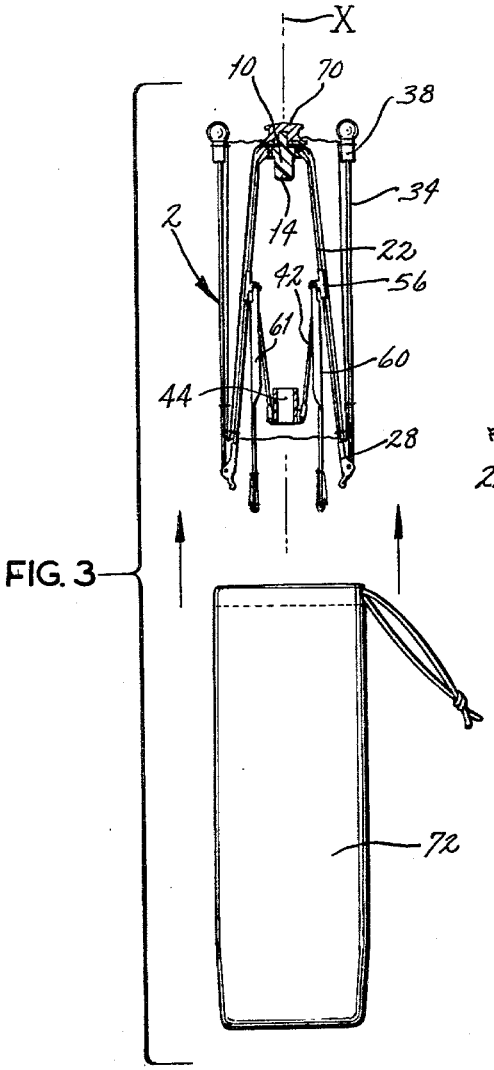
FIG. 3
FIG. 4
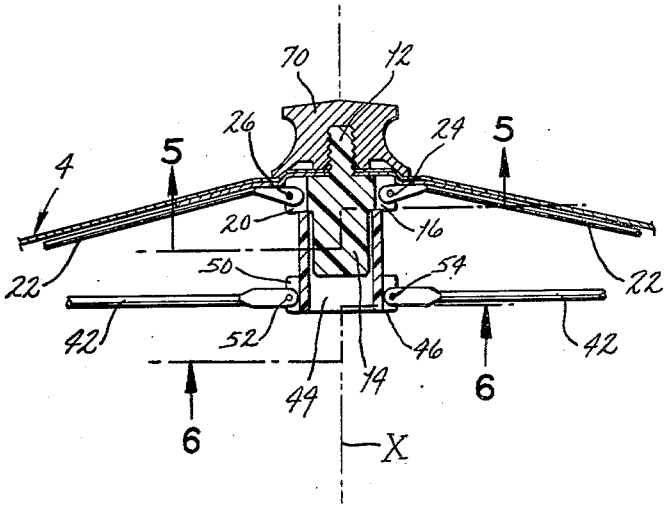
FIG. 7
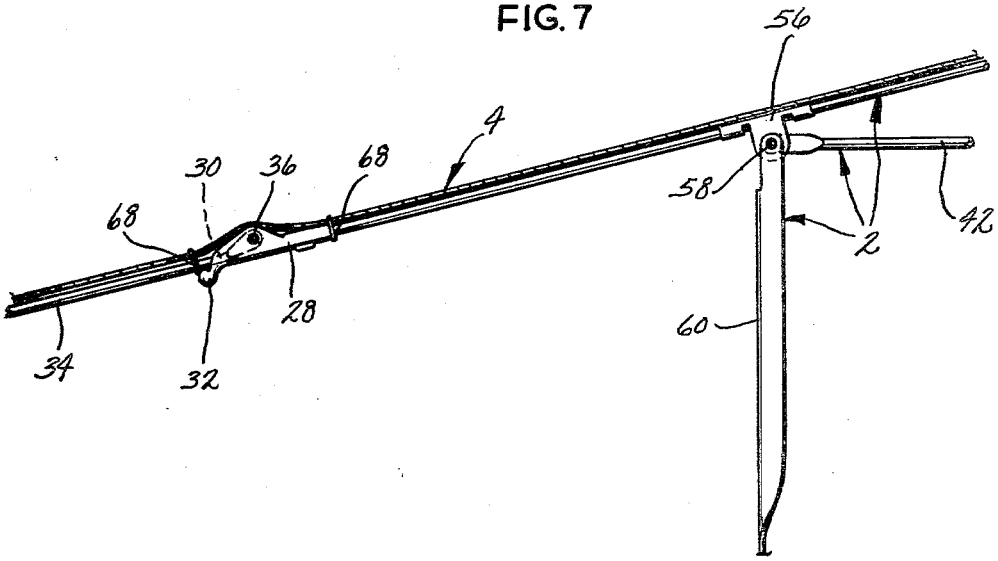

COLLAPSIBLE SUNSHADE

BACKGROUND OF THE INVENTION

This invention relates in general to head gear and, more particularly, to a collapsible sunshade capable of being worn on the head much like a hat.

For individuals who are outdoors during the hot summer months, protection from the direct rays of the sun is often not readily available. This is particularly true of spectators at sporting events such as baseball games. Wide brim hats offer some protection from the sun, but usually not enough. Moreover, they are quite heavy and almost wholly lacking in ventilation. As a result they are quite uncomfortable.

SUMMARY OF THE INVENTION

One of the principal objects of the present invention is to provide a sunshade which is worn as head gear and when so worn provides a large shaded area beneath the wearer's head. Another object is to provide a sunshade which is light in weight and affords a large measure of ventilation. A further object is to provide a sunshade of the type stated which collapse into a highly compact carrying package. These and other objects and advantages will become apparent hereinafter.

DESCRIPTION OF THE DRAWINGS

FIG. 3 is a sectional view of the sunshade in its collapsed condition;

FIG. 4 is an enlarged view showing the hub and sleeve of the sunshade frame;

FIG. 7 is an enlarged view of the sunshade at a pivot joint between a rib and its rib extension and also at the pivot joint between the same rib and its strut.

DETAILED DESCRIPTION

Figure 1:
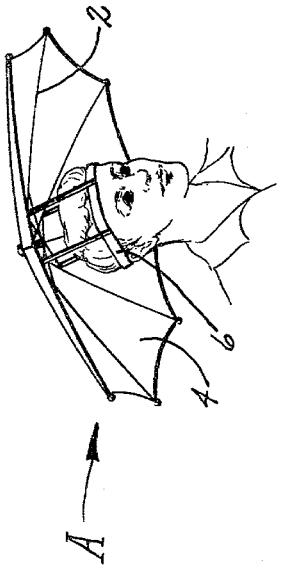
FIG. 1 is a perspective view of the sunshade as it is worn by the user.

Referring now to the drawings (FIG. 1), A designates a sunshade which somewhat resembles an umbrella in appearance but is smaller. The sunshade A is worn on the head much like a hat, only the major portion of it is positioned above the head so that the scalp area receives maximum ventilation. The sunshade A furthermore projects a substantial distance in all directions beyond the head so that a relatively large area is shaded. The sunshade A includes a collapsible frame 2 and a fabric cover 4 which fits over the frame 2 and is permanently attached to it. It further includes a fabric head band 6 which is also attached to the frame 2. The headband 6 fits around the user's head and is adjustable to accommodate heads of varying size.

The frame 2 has a hub 10 (FIG. 4) which is preferably injection molded from a suitable plastic and has a threaded upper portion 12, a cylindrical lower portion 14 and enlarged flange-like central portion 16. The central portion 16 has an outwardly opening peripherical groove 18 (FIG. 5) and radially directed slots 20 which are spaced at equal circumferential intervals. The slots 20 likewise open outwardly and they interrupt the groove 18. The hub forms a center axis X for the sunshade A.

Figure 5:
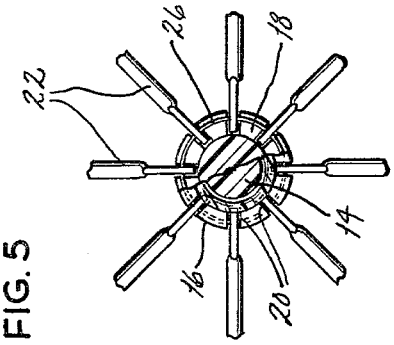
FIG. 5 is a sectional view taken along line 5—5 of FIG. 4 and showing the lower end of the hub.
Figure 2:
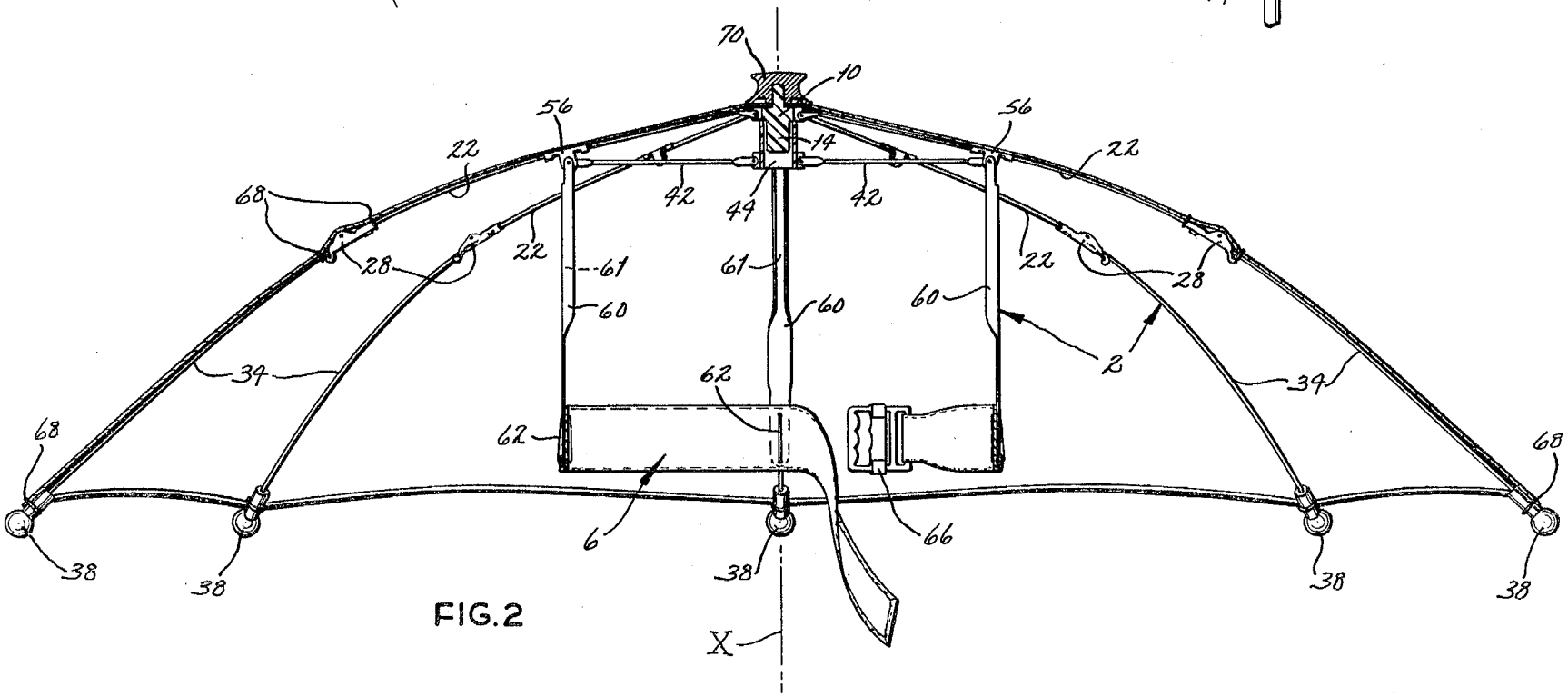
FIG. 2 is a sectional view of the sunshade in its erected condition.

The hub 10 serves to connect together a plurality of ribs 22 (FIG. 2) which radiate from it. Each rib 22 is formed from a straight somewhat flexible metal rod of circular cross section which is flattened at its upper end, with the flattened portion being located at about a 30° angle with respect to the remainder of the rib 22. The ribs 22 at their flattened portions fit into the radial slots 20 of the hub 10, there being a different flattened portion in each slot 20 (FIGs. 4 and 5). Moreover, each flattened portion is provided with an aperture 24 (FIG. 4) which aligns with the peripheral groove 18 of the central portion 14, and extended through the groove 18 as well as through the apertures 24 is a retaining wire 26 (FIGS. 4 and 5), the ends of which are twisted together to firmly retain the wire 26 in the groove 18. The wire 26 in turn retains the flattened upper portions of the ribs 22 in their respective slots 20, yet serves as a pivot point for each rib 22.

Each rib 22 at its lower end is fitted with a stop ferrule 28 (FIG. 7) having an upwardly opening channel 30 located beyond the rod portion of the rib 22 and a bulbous or somewhat spherical stop 32 located at the end of the channel 30 with its uppermost surface being at about the elevation of the base of the channel 30.

The channel 30 in the ferrule 28 receives the end of a rib extension 34 which, like the rib 22 itself, is a straight rod formed from a somewhat flexible metal. The portion of the rib extension 34 which fits into the channel 30 is flattened and is connected to the ferrule 28 by a rivet 36 which passes through the side walls of the ferrule 28 and through the flattened end portion of the rib extension 34. Thus, the ferrule 28 and rivet 36 serve as a connecting element for joining the rib 22 and the rib extension 34. This arrangement enables the rib extensions 34 to fold between folded and extended positions. In the folded position, each rib extension 34 lies along the rib 22 to which it is connected, with the rib extension 34 being presented outermost (FIG. 3). When the rib extension 34 is in its extended position, it forms a generally straight-line continuation of the rib 22. In this position, the stop 32 bears against rib extension 34 slightly beyond the rivet 36 by which it is connected to the ferrule 28, and the stop 32 prevents the rib extension 34 from swinging beyond the straight line position. Thus, the rib extension 34 can be folded over onto the top or outside of the rib 22, but cannot be folded in the opposite direction. The rib extensions 34 at their far ends are fitted with cover retainers 38 (FIG. 2), each of which is preferably injection molded from plastic in a sleeve like configuration and with a blunted end.

Figure 6:
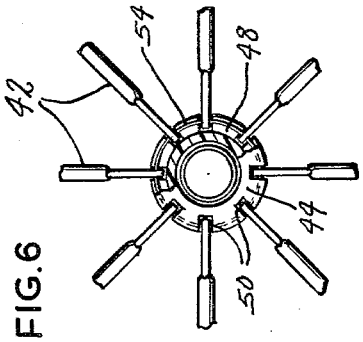
FIG. 6 is a sectional view taken along line 6—6 of FIG. 4 and showing the lower end of the sleeve.

In addition to the ribs 22 and the rib extensions 34, the frame 2 further includes struts 42 (FIGS. 2, 4 and 6) which emanate from a sleeve 44 and underlie the ribs 22 when the sleeve 44 is brought up against the hub 10 so as to hold the ribs 22 in an erected position in which they radiate from the hub 10. The sleeve 44, which constitutes an actuating element, lies along the center axis X and its inside diameter is slightly greater than the diameter of the cylindrical lower portion 14 of the hub 10 so that the portion 14 is easily received in the sleeve 44. At its lower end, the sleeve 44 is provided with a flange 46 (FIG. 4) having an outwardly opening peripheral groove 48 (FIG. 6) and outwardly opening radial slots 50 which are spaced at equal intervals around the flange 46. The struts 42 at their inner ends are flattened and provided with apertures 52 (FIG. 4) which align with the groove 48, and extended through the groove 48 and apertures 52 is a wire 54, the ends of which are twisted tightly together so the wire 54 is retained in the groove 48. The wire 54 not only retains the ends of the struts 42 in the radial slots 50, but also serves as a pivot for the struts 52.

At their opposite ends, the struts 52 are connected to ferrules 56 (FIG. 7) mounted firmly on the ribs 22 intermediate the ends of the ribs 22. The ferrules 56 are of a bifuricated nature and the outer ends of the struts 42 are located between the tines of the ferrules 56. Extended through the tines of each ferrule 56 and the end of the strut 42 at that ferrule 56 is a rivet 58. The length of the struts 42 is such that when the sleeve 44 is moved upwardly to the point that the cylindrical lower portion 14 of the hub 10 is received in the sleeve 44 with the end of the sleeve 44 against the central portion 16 (FIG.2), the struts 42 are generally perpendicular with respect to the center axis X, while the ribs 22 project outwardly from the hub 10. Actually, the struts 42 are located over center at an angle slightly less than a right angle with respect to the center axis X, while the ribs 22 are located at a slightly smaller angle with respect to the axis X.

Not only do the rivets 58 connect the struts 42 to the ribs 22, but they further connect upright positioning legs 60 (FIG. 7) to every other rib 22. Each positioning leg 60 is bifuricated at its upper end, and the tines are spread far enough apart to fit over the tines on the intermediate ferrules 56. The rivets 58 extend through the tines of their respective ferrules 56 and positioning legs 60, as well, thereby enabling the legs 60 to depend from those ribs 22 to which they are attached. The legs 60 for the most part are channel-shaped in cross sectional configuration, having longitudinal channels 61 (FIG. 2) which open inwardly, but at their lower ends the legs 60 are flat, with the flat surfaces facing inwardly toward the center axis X.

The headband 6 passes along the flat inside faces of the legs 60, it being held to those legs by threads 62 which extend through apertures 64 in the legs 60. The head band 6 is provided with a buckle 66 so that its size may be adjusted.

The cover 4 is generally circular in shape when unfolded and it lays over the ribs 22 and rib extensions 34, it being secured to the ribs 22 and rib extensions 34 by loop stitches 68 (FIGS. 2 and 7) which pass around them. More loop stitches 68 pass through the cover 4 at its periphery and also through cover retainers 38 at the ends of the rib extensions 34. Finally, the cover 4 at its center is provided with an aperture through which the threaded upper portion 12 of the hub 10 fits, and a cap 70 (FIGS. 2 and 4) threads over the upper portion 12 to hold the center of the cover 4 against the hub 10. To this end, the cap 70 has a downwardly and outwardly directed flange at its lower end, and this flange overlies the cover 4.

The sunshade A is normally carried in a collapsed condition (FIG. 3) wherein the hub 10 and sleeve 44 are spaced from each other and the rib 22, rib extensions 34, struts 42, and legs are all generally parallel to the center axis X and are together in a side-by-side condition around that axis. More specifically the ribs 22 extend downwardly from the hub 10 and are disposed around the sleeve 44 with the ferrules 28 being located somewhat lower than the sleeve 44. The rib extensions 34 extend upwardly from the ferrules 28 and are located outwardly from the ribs 22. The cover retainers 38 on the upper ends of the rib extensions 34 are positioned around the cap 70. The positioning legs 60, on the other hand, are located inwardly from the ribs 22 to which they are connected and the struts 42 are located still further inwardly. Indeed, the struts 42 which are connected to the ribs 22 to which legs 60 are also connected, lie inside the channels 61 formed in those legs 60. The struts 42 at their lower ends, of course, terminate at the sleeve 44, which is located well below the hub 10, and the legs 60 extend downwardly even further so that the collapsed head band 6 is located even below the stop ferrules 28 on the ribs 22. The fabric cover 4, being attached to the ribs 22 and rib extensions 34 is folded up with the frame 2 such that it doubles back upon itself at the stop ferrules 28.

When in the collapsed condition, the sunshade A fits easily into a small carrying bag 72 which prevents the frame 2 from opening.

To erect the sunshade A (FIG. 2), the rib extensions 34 are first folded outwardly until they are against the stops 32 on the stop ferrules 28 to which they are connected. When so disposed, the rib extensions 34 form generally straight line continuations of the ribs 22. Next the sleeve 44 is moved upwardly toward the hub 10, and as the sleeve 44 and hub 10 come together, the ribs 22 and struts 42 swing outwardly. The sleeve 44 is aligned with the cylindrical lower portion 14 on the hub 10 so during the final increment of movement the cylindrical portion 14 of the hub 10 is received in the sleeve 44. During this increment, the fabric cover 4 is stretched taut and the struts 42 pass over center so to speak, that is they pass beyond a position truly perpendicular to the center axis X. The stretched cover 4 of course urges the struts 42 inwardly, but since the sleeve 44 has passed over center, the inwardly directed force urges the sleeve against the hub 10 and keeps the sleeve 44 engaged with the cylindrical portion 14 on the hub 10. The sunshade A may, of course, also be used to protect the wearer's head during inclement weather.

What is claimed is:

1. A headgear comprising: a frame including a hub having a center axis, a plurality of ribs pivotally connected to the hub, an actuating element aligned with the hub and movable toward and away from the hub along the center axis, and a plurality of struts interposed between and pivotally connected to the actuating element and the ribs, the length of the struts being such that when the actuating element is moved to a position against the hub the ribs will be in an erected position in which they radiate from the hub, but when the actuating element is moved to a spaced position away from the hub, the ribs and struts will assume a collapsed position in which they extend generally in the same direction as the center axis and lie along the center axis slightly outwardly therefrom, with the struts being located inwardly from the ribs; legs pivotally connected at their upper ends to the frame in alignment with at least some of the struts and extending downwardly away from their respective struts when the ribs and struts are in their erected position, the legs extending generally in the same direction as and being located between their respective struts and ribs when the ribs and struts are in their collapsed position, the legs further having inwardly opening channels which receive the struts when the struts and ribs are in their collapsed position; and a headband connected to the legs at their lower ends.

2. A headgear according to claim 1 wherein the legs have flat portions which merge into the channels and face inwardly, the flat portions being located opposite the actuating element when the ribs and struts are in the collapsed position, and the headband being attached to the flat portions of the legs.

3. A headgear according to claim 1 wherein the legs are pivotally connected to the respective ribs where the struts are connected to the ribs, so that the legs and struts pivot about the same axis.

4. A headgear according to claim 1 and further comprising rib extension pivotally connected to the ribs beyond the hub and the struts and adapted to swing from an extended position wherein they form continuations of their respective ribs to folded positions wherein they lay alongside their respective ribs.

5. A collapsible headgear according to claim 1 wherein each leg has its channel at its upper end and is generally flat at its lower end, and the side walls of the channel project inwardly beyond the flat lower end.

6. A collapsible headgear comprising: a hub having a center axis; a plurality of ribs connected to the hub such that that ribs are capable of moving inwardly toward the center axis to assume a collapsed position in which they are generally parallel to the center axis and outwardly away from the center axis to an extended position in which they are at a substantial angle to the center axis; an actuating element movable along the center axis toward and away from the hub; struts connected to and extended between the actuating element and the ribs, the struts being hinged to both the actuating element and to the ribs such that the struts will lie along the ribs when the actuating element is located furthest from the hub and the ribs are in their collapsed position and will urge the ribs outwardly to their extended positions as the actuating element is moved toward the hub, the inner ends of the struts being spaced axially from the inner ends of the ribs when the ribs are in their extended positions so that the struts maintain the ribs in their extended positions, the struts being short enough to locate the actuating element between the ends of the ribs when the ribs are in their collapsed positions; a connecting element on the end of each rib, each connecting element having an upwardly opening channel, a hinge pin extended across the channel, and a bulbous stop at the outer end of the channel, with the stop being offset from the rib such that it is below the rib when the rib is in its extended position; rib extensions having inner ends fitted into the channels of the connectors and attached to the connectors by the hinge pins such that the rib extensions are capable of folding upwardly with respect to the ribs and overlying the ribs when so folded, and are also capable of folding downwardly against the stops, the rib extensions when against the stops forming outward continuations of their respective ribs; legs hinged to and extending downwardly from at least some of the struts so to enable the struts to fold against and overlie the legs when the ribs are in the collapsed position; a head band connected to the legs at their lower ends and being adapted to fit around the user's head; and a flexible cover extended over and being attached to the ribs and rib extensions so that the cover will fold with the ribs and rib extensions.

7. A headgear according to claim 6 wherein the struts, as the actuating element moves toward the hub, pass through a position in which they are at right angles to the center axis, and when the sleeve is against the hub, the struts are at an angle slightly less than a right angle.

8. A headgear according to claim 7 wherein the actuating element is a sleeve and the hub has a cylindrical lower portion which is received by the sleeve as the sleeve moves against the hub.

9. A headgear according to claim 6 wherein the legs are pivotally connected to their respective struts along the same pivot axes as are the ribs connected to those struts.

10. A headgear according to claim 9 wherein the legs are channel-shaped and lie between the ribs and the struts when the ribs are in their collapsed positions.

11. A headgear according to claim 10 wherein the channel for each leg receives the strut associated with that leg when the ribs are in their collapsed positions.

* * * * *